US009243876B1

(12) United States Patent
Botthof et al.

(10) Patent No.: US 9,243,876 B1
(45) Date of Patent: Jan. 26, 2016

(54) LOW-COLLATERAL DAMAGE DIRECTED FRAGMENTATION MUNITION

(71) Applicant: Raytheon Company, Waltham, OH (US)

(72) Inventors: Brian S. Botthof, Vail, AZ (US); Kim L. Christianson, Oro Valley, AZ (US); Henri Y. Kim, Tucson, AZ (US); Garrett L. Hall, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/337,643

(22) Filed: Jul. 22, 2014

(51) Int. Cl.
*F42B 12/22* (2006.01)

(52) U.S. Cl.
CPC ..... *F42B 12/22* (2013.01)

(58) Field of Classification Search
CPC ..... F42B 12/22; F42B 12/32; F42B 12/24
USPC ..... 102/492
See application file for complete search history.

(56) References Cited

U.S. PATENT DOCUMENTS

| | | | | | |
|---|---|---|---|---|---|
| 1,992,690 | A | * | 2/1935 | Decker | 102/353 |
| RE25,685 | E | * | 11/1964 | Griffith | 102/318 |
| 3,356,024 | A | * | 12/1967 | Driscoll et al. | 102/202.6 |
| 3,970,005 | A | * | 7/1976 | Rothman | 102/492 |
| 4,524,696 | A | * | 6/1985 | Altenau et al. | 102/491 |
| 5,090,324 | A | * | 2/1992 | Bocker et al. | 102/307 |
| 5,105,742 | A | | 4/1992 | Sumner | |
| 5,191,169 | A | | 3/1993 | Hu | |
| 5,540,156 | A | | 7/1996 | Fong | |
| 7,930,978 | B1 | * | 4/2011 | Dupont et al. | 102/492 |
| 8,161,884 | B1 | | 4/2012 | Kokodis et al. | |
| 8,528,480 | B2 | * | 9/2013 | Seidel et al. | 102/492 |
| 8,720,342 | B1 | * | 5/2014 | Gold et al. | 102/495 |
| 2011/0094408 | A1 | | 4/2011 | Dupont et al. | |
| 2011/0146523 | A1 | | 6/2011 | Kim et al. | |
| 2011/0179966 | A1 | * | 7/2011 | Dupont et al. | 102/492 |
| 2012/0240806 | A1 | * | 9/2012 | Gonsalves et al. | 102/275.11 |
| 2012/0279411 | A1 | * | 11/2012 | Daoud et al. | 102/497 |

OTHER PUBLICATIONS

U.S. Appl. No. 14/337,634, filed on Jul. 22, 2014.
Office Action of Oct. 28, 2015, in U.S. Appl. No. 14/337,634.

* cited by examiner

*Primary Examiner* — Joshua Freeman
(74) *Attorney, Agent, or Firm* — Renner, Otto, Boisselle & Sklar, LLP

(57) ABSTRACT

A directed munition has a non-fragmentation casing, and an explosive within the casing that is configured to propel fragments out an opening of the casing when the explosive is detonated. The casing may be made of a material that does not produce lethal or injurious fragments when the explosive is detonated. The explosive may include an insensitive explosive portion that creates the shape of an explosive front, and a secondary explosive containing a more energetic explosive, which is closer to the fragments than the insensitive explosive portion. There may be more of the insensitive explosive than the relatively energetic explosive. The munition may have a ring that is operatively coupled to the fragments, to aid in directing the fragments out of the casing opening in a desired direction. The ring may be made of a material that does not produce injurious fragments when the explosive is detonated.

20 Claims, 2 Drawing Sheets

LOW-COLLATERAL DAMAGE DIRECTED FRAGMENTATION MUNITION

FIELD OF THE INVENTION

The invention relates to fragmentation munitions and warheads.

DESCRIPTION OF THE RELATED ART

Fragmentation warheads expel metal fragments upon detonation of an explosive. Fragmentation warheads are used as offensive weapons or as countermeasures to anti-personnel or anti-property weapons such as rocket-propelled grenades. A typical warhead includes an explosive inside a steel case. A booster explosive and safe and arm device are positioned in an aft section of the case to detonate the main explosive. A fragmentation assembly is placed in an opening in a fore section of the case against the flat leading surface of the explosive. The fragmentation assembly will typically include scored metal or individual fragments (pre-formed) such as spheres or cubes to control the size and shape of the fragments so that the fragments are expelled in a predictable pattern and speed. Scored metal produces about an 80% mass efficiency while individual fragments are expelled with mass efficiency approaching 100%, where mass efficiency is defined as the ratio of fragment mass expelled (therefore effective against the intended target) to the total fragment mass. In other words, the mass efficiency is the ratio of the total mass less the interstitial mass that was consumed during the launch process (therefore ineffective against the intended target) to the total mass.

The steel case confines a portion of the radial energy of the pressure wave (albeit for a very short duration) caused by detonation of the explosive and redirects it along the body axis of the warhead to increase the force of the blast that propels the metal fragments forward with a lethality radius of, for example, 25-50 meters. The lethality radius is defined as the radius of a virtual circle composed of the sum of all lethal areas (zones) meeting a minimum lethal threshold. For example, the lethality threshold may occur when 1% of people at that radius are killed. These fragments are generally expelled in a forward cone towards the intended target. The density of fragments per unit area is maximum near zero degrees and falls off with increasing angle, with tails that extend well beyond the desired cone. As a result, the warhead has a maximum lethality confined to a very narrow angle and expels a certain amount of lethal fragments outside the desired target area that may cause collateral damage. This means that the aimpoint and detonation timing tolerances to engage and destroy the threat while minimizing collateral damage are tight.

Detonation of the high explosive produces a blast that has a much smaller lethality radius, maybe 3 meters in this example, in all directions caused by the pressure wave of the blast. The detonation and subsequent expansion also fractures the steel case into metal fragments of various shapes and sizes that are thrown in all directions, beyond the lethality radius of the blast. In this example, the expelled metal fragments from the case may have a lethality radius of 5-8 meters. Fragmentation of the steel case increases the potential for collateral damage without improving the lethality of the warhead to destroy the threat.

One approach to this problem has been to replace the steel case with a casing that is pulverized into fine particles upon detonation, as described in U.S. Patent Publication 2011/0146523 A1, in conjunction with use of a metal ring and a pattern shaper. However this approach does not fully address the problems of producing a desired spread of fragments while reducing potential collateral damage from the munition.

SUMMARY OF THE INVENTION

According to an aspect of the invention, a directed munition includes: a casing; an explosive within the casing; and fragments operatively coupled to the explosive, to be directed out of a front opening of the casing when the explosive is detonated. The explosive includes an insensitive explosive portion containing an insensitive explosive, and an energetic explosive portion that contains a relatively sensitive explosive that is more energetic than the insensitive explosive. The energetic explosive portion is closer to the fragments than the insensitive explosive portion.

According to another aspect of the invention, a directed munition includes: a casing; an explosive within the casing; fragments operatively coupled to the explosive, to be directed out of a front opening of the casing when the explosive is detonated; and a ring at least partially within the casing. The ring is operatively coupled to the fragments to control spread of the fragments out of the opening, when the explosive is detonated. The ring is made of a material that is mostly reduced to powder upon detonation of the explosive To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A directed munition has a non-fragmentation casing, and an explosive within the casing that is configured to propel fragments out an opening of the casing when the explosive is detonated. The casing may be made of plastic or a composite material, or another low density material that does not produce lethal or injurious fragments when the explosive is detonated. The explosive may include an insensitive explosive portion that creates the shape of an explosive front, and a secondary explosive containing a more energetic explosive, which is closer to the fragments than the insensitive explosive portion. There may be more of the insensitive explosive than the relatively energetic explosive, with the insensitive explosive for example constituting a majority of the circumferential surface area of the explosive.

Figure 1:
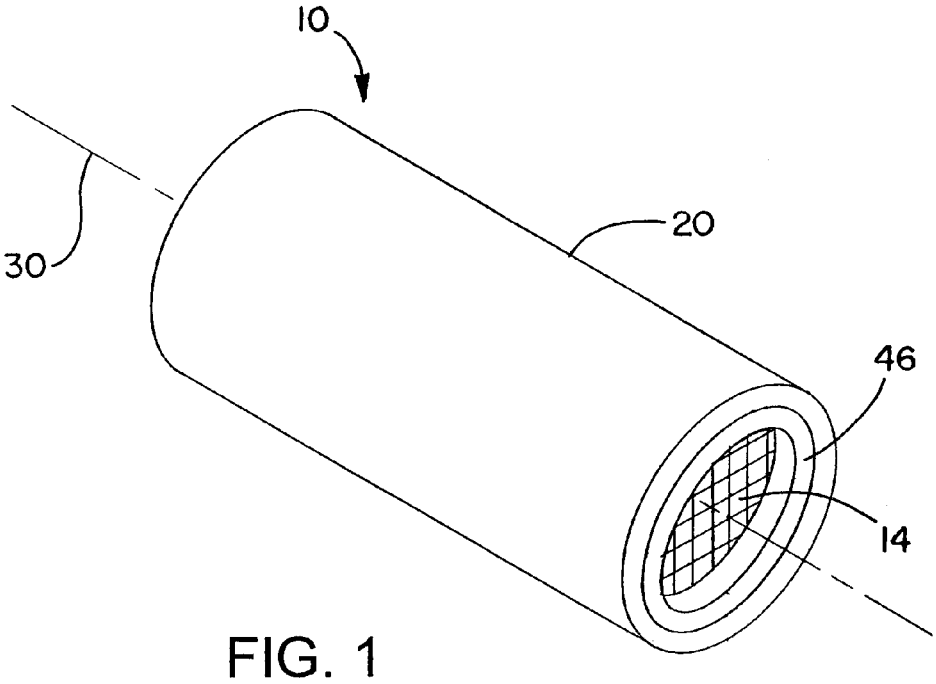
FIG. 1 is an oblique view of a munition in accordance with an embodiment of the present invention.
Figure 2:
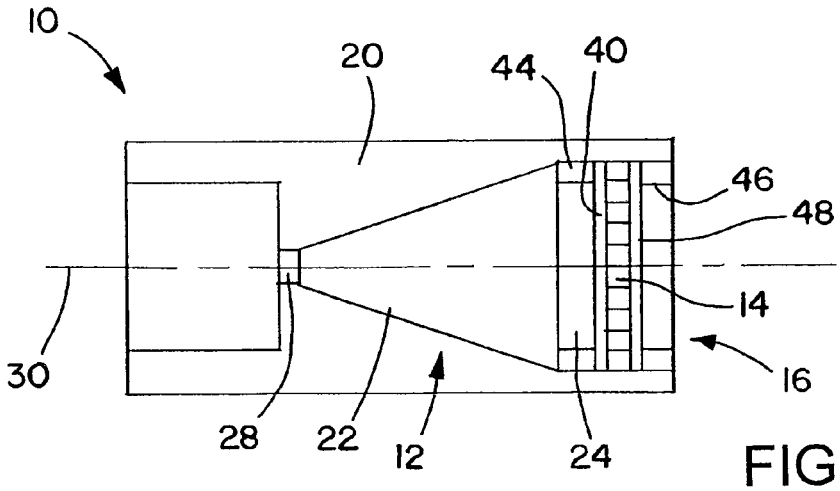
FIG. 2 is a side sectional view of the munition of FIG. 1.

FIGS. 1 and 2 show a munition 10 that uses an explosive 12 to direct fragments 14 out of an opening 16 in the front of a casing 20 that encloses the explosive 12 and the fragments 14. The munition 10 that is shown in FIG. 1 may be a warhead that is part of an interceptor that is fired to engage and destroy an incoming threat, such as a rocket-propelled grenade. The explosive 12 is in two parts or portions, an insensitive explosive portion 22 and an energetic explosive portion 24. The insensitive explosive portion 22 contains an insensitive explosive, a term which is used herein to refer to explosives that are chemically stable enough to withstand mechanical shocks such as impacts (for example from bullets, explosive-driven fragments, or shrapnel) without inducing an undesired reaction. The insensitive explosive portion 22 acts as a primary explosive, with detonation of the insensitive explosive initiated by a booster 28. The booster or detonator 28 is at one end of the explosive 12, on the opposite end of the casing 20 from the fragments 14 and the opening 16. Firing of the booster or detonator 28 may be initiated by a suitable device, perhaps including a suitable safe-and-arm mechanism. The detonation of the insensitive explosive portion 22 creates the shape of the detonation front, which propagates toward the energetic explosive portion 24. The munition 10 may be axisymmetric about a longitudinal axis 30.

The energetic explosive portion 24 contains a relatively energetic explosive material that is more energetic than the insensitive explosive material of the portion 22, and that has a faster detonation propagation speed than the insensitive explosive. The insensitive explosive of the portion 22 has a figure of insensitivity that is less than the figure of insensitivity of the relatively energetic explosive material of the energetic explosive portion 24. A sensitive explosive is such that its response to shock or thermal stimulus is violent, for example detonation. The energetic explosive portion 24 is a secondary explosive that is detonated by the primary explosive, the insensitive explosive portion 22. The faster detonation propagation speed in the energetic explosive portion 24 acts to expel the fragments 14 with great speed out of the casing opening 16.

The two-part explosive 12 provides good performance, with the fragments 14 expelled with sufficient force (at sufficient speed) to do damage, while still providing a munition that is safe to handle and use. Since most of the explosive 12 is insensitive to detonation from bullets or other impacts, the munition 10 is less likely to be detonated before firing than munitions with only energetic explosives. Thus the munition 10 provides improved safety, especially when being carried in combat by or near friendly personnel that could be injured by undesired detonation of the munition 10.

The explosive materials in the explosive 12 may be any of a variety of suitable explosive materials. For example, the insensitive explosive for the insensitive explosive portion 22 may be PBXN-9 explosive, and the more energetic explosive for the energetic explosive portion 24 may be PBXN-5, PBXN-11, Octol, or LX-14 explosives. The listed explosives are only examples, and many other explosives may be used as alternatives, or in addition to those listed above.

The insensitive explosive portion 22 may make up the bulk of the explosive 12, for example providing a majority of the volume of the explosive 12, with the insensitive explosive portion 22 having a greater volume than the energetic explosive portion 24. By having a significant volume of the explosive 12 taken up by the insensitive explosive portion 22, the likelihood of detonation from a stray bullet or other impact is reduced. This makes the munition 10 safer to handle, both before and during combat, than it would be if all of the explosive was of a more energetic material.

Alternatively or in addition, a surface area of a circumferential surface of the insensitive explosive portion 22 (the conical outer surface of the portion 22) may be greater than a surface area of a circumferential surface of the energetic explosive portion 24 (the conical outer surface of the portion 24). The reduction of the side area of the most volatile portion of the explosive 12 reduces the chance of undesired reaction of the explosive 12.

As an alternative, the explosive 12 may be all of the same type. For example, the explosive 12 may alternatively be composed of a single explosive material that is sufficiently energetic to propel the fragments 14 as desired. However, use of a single explosive material precludes obtaining the advantages discussed above that come from use of a two-part explosive.

The explosive 12 have a generally conical shape, with the insensitive explosive portion 22 at the narrow end of the conical shape, and the energetic explosive portion 24 at the wider end of the conical shape. The wider end of the explosive 12, part of the energetic explosive portion 24, faces toward the fragments 14 and the casing opening 16. In the illustrated embodiment the insensitive explosive portion 22 has a conical shape, and the energetic explosive portion 24 has a disk shape. Alternatively the explosive 12 may have a different shape, such as a being a right circular cylinder.

A fragment liner 40 may be located between the explosive 12 and the fragments 14. The fragment liner 40 helps in supporting the fragments 14 and in containing the high-pressure detonation product produced by the explosive 12, to ensure that the high pressure is confined to maximize the velocity of the expelled fragments. The liner 40 may also maintain the fragments 14 in place, for example by having the fragments 14 adhered to the liner 40, such as by use of RTV silicone or another suitable adhesive. The fragment liner 40 also may reduce the chance of spalling of the fragments 14. The fragment liner 40 may be made of aluminum or another suitable material.

The munition 10 also may have a ring 44 around the energetic explosive portion 24, to aid in directing the force from the explosive axially out of the opening 16, rather than radially through the casing 20. The ring 44 may be made of a harder and/or denser material than the material of the casing 20. In addition, the ring 44 may be made of a material that does not produce lethal fragments when the explosive 12 is detonated. For example, the ring 44 may be made of a pressed metal powder, for example a sintered metal alloy powder made using a hot isostatic pressing process or other sintering process. Such a ring possesses enough structural integrity to direct the explosive force axially rather than radially. But when the ring 44 disintegrates under the explosive force it turns to relatively harmless powder, rather than larger fragments. This protects friendly forces that may be nearby the munition 10, but outside of the line of fire, when the munition 10 is fired.

The ring 44 may be made of a denser material than the material of the casing 20, with the ring 44 being for example being at least five times as dense as the casing 20. In one embodiment the ring 44 may have a density that is 9-10 times the density of the casing 20. The ring 44 may be made of or may include a refractory metal, or may have a similar density to a refractory metal. The ring 44 may be made of tungsten or depleted uranium, to give non-limiting examples.

In the illustrated embodiment the ring 44 is around the energetic explosive portion 24. Alternatively the ring 44 may be placed in other ways within the casing 20. For example the ring 44 may extend to be around all or part of the fragments 14. As another example the ring 44 may extend to be around part of the insensitive explosive portion 22. Also, the ring 44 may not be around all of the energetic explosive portion 24.

A retainer 46 may be used to keep the fragments 14 and other parts of the munition 10 in place in the casing 20 prior to the detonation of the explosive 12. The retainer 46 may be a ring of lightweight material, such as suitable plastic. A lightweight covering 48 (not shown in FIG. 1) may be used to prevent ingress of moisture and/or other impurities into the casing 20.

The fragments 14 may be in any of a variety of suitable shapes, such as cubes and/or spheres. The fragments 14 may be made a heavy metal, such as a tungsten alloy, or other suitable materials, such as steel or other metals. Weight of each of the fragments 14 may be from 0.5 grams to 10 grams, to give a non-limiting range.

The casing 20 may be made of a material that is mostly (or substantially all) pulverized or otherwise reduced to non-lethal fragments by the detonation of the explosive 12. The casing 20 may be formed of a material such as a fiber reinforced composite, engineered wood, thermoplastic (resin, polymer), or even a foam that may be pulverized into a cloud of harmless fine particles upon detonation of the explosive. Another alternative material for the casing 20 is a suitable plastic. The particles produced in the explosion have a mass efficiency near 0% and no greater than 1%, so that the lethality radius of the expelled particles is no greater than the lethality radius of the blast from the detonating explosives. Consequently, the threat to the soldiers on either side of the munition 10 is reduced to the threat posed by the blast.

The munition 10 described above may be used as a warhead in conjunction with a wide range of interceptors including projectiles and self-propelled missiles and spinning or non-spinning and various guidance systems. The aiming and detonation sequence may be computed and loaded into the interceptor prior to firing. For example, in a close-range countermeasure system, the guidance system will determine when to fire a sequence of motors on the interceptor and when to detonate the warhead. This sequence may be loaded into the interceptor prior to launch. A more sophisticated longer range missile might fly to a target and compute its own aiming and detonation sequences or have those sequences downloaded during flight.

Figure 3:
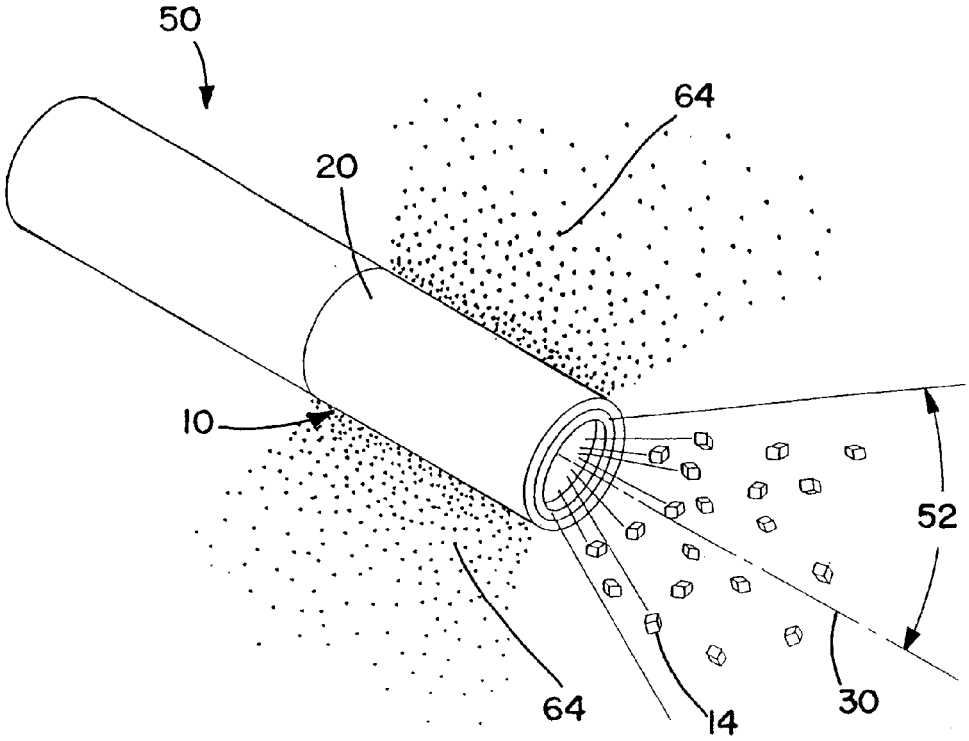
FIG. 3 is an illustration showing effects of detonation of the munition of FIG. 1.

With reference now in addition to FIG. 3, the munition 10 is shown as part of a missile 50. The munition 10, acting as a warhead on the missile 50 may when detonated spread the fragments 14 in a preferred direction, in a cone having a half angle 52 around the longitudinal axis 30. The fragments 14 may be expelled with an approximately uniform density over the half angle 52. The half-angle 52 may be from 5 degrees to 10 degrees, or may have other suitable values. It is desirable that the munition be detonated at a location where it is able to destroy an incoming threat with a high likelihood of success, while minimizing the threat of collateral damage to the troops or, more generally, to any person or object other than the engaged threat. To this end, the munition 10 may be detonated at a standoff distance away from the threat, to expel the fragments 14 in the prescribed half angle 52, to destroy the threat.

Ideally, the threat of injury or other damage outside of the half angle 52 is minimal, for instance being reduced essentially to the threat posed by the blast, since the casing 20 (FIG. 1) and the ring 44 (FIG. 2) may both be reduced (pulverized) to a powder of fine particles 64 by the explosion. As noted above, the particles 64 may have a mass efficiency of 1% or less, so that the lethality outside of the half angle 52 is approximately the same as the lethality from the blast. For typical countermeasure-sized warheads the blast may pose a threat only to a distance of a few meters.

Figure 4:
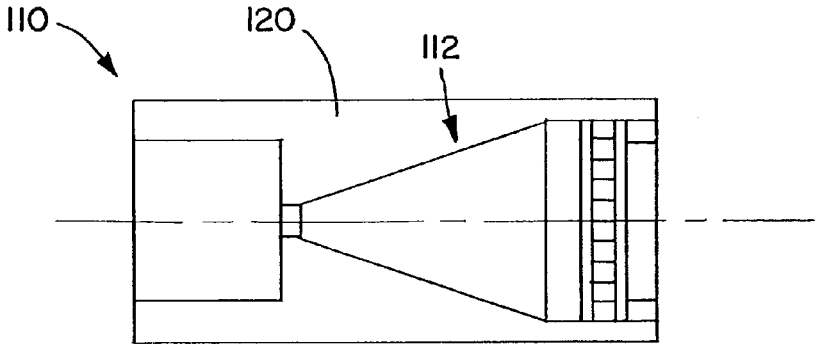
FIG. 4 is a side sectional view of a munition in accordance with an alternate embodiment of the invention.

FIG. 4 shows an alternate embodiment munition 110, which is similar to the munition 10 (FIG. 1), except that the ring 44 (FIG. 2) is omitted. The munition 110 achieves many of the advantages of the munition 10, since it uses a two-part explosive 112 that is similar to the explosive 12 (FIG. 2) that is described above with regard to the munition 10. The munition 110 has a light weight due to its use of a lightweight low-fratricide casing 120 that is similar to the casing 20 (FIG. 1) of the munition 10. Weight of the munition 110 is further reduced by omitting a metal ring inside the casing. Further details of parts of (and alternatives for) the munition 110 that are similar to corresponding parts of the munition 10 are omitted.

The munitions 10 and 110 present many advantages over prior devices. One advantage is the reduced danger to friendly troops through use of the casings 20 and 120, and the ring 44, that may be mostly or nearly completely pulverized (or otherwise be rendered non-injurious) during detonation. Another advantage is the reduced chance of unwanted detonation from impact of bullets, shrapnel, or other objects, resulting from use of the insensitive explosive. The munitions 10 and 110 also have a light weight (due to the lightweight low-fratricide casing).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A directed munition comprising:

a casing;

an explosive within the casing;

a detonator; and fragments operatively coupled to the explosive, to be directed out of a front opening of the casing when the explosive is detonated;

wherein the explosive includes an insensitive explosive portion containing an insensitive explosive, and an energetic explosive portion that contains a relatively sensitive explosive that is more energetic than the insensitive explosive;

wherein the energetic explosive portion is closer to the fragments than the insensitive explosive portion; and wherein the detonator is operatively coupled to the insensitive explosive portion, to detonate the insensitive explosive portion as a primary explosive.

2. The directed munition of claim 1, wherein the insensitive explosive portion has a larger circumferential surface area than the energetic explosive portion.

3. The directed munition of claim 1, wherein at least part of the explosive has a conical shape, with a wider end of the explosive that is part of the energetic explosive portion, facing toward the opening of the casing.

4. The directed munition of claim 1, wherein the casing is a non-fragmentation casing that is mostly pulverized upon detonation of the explosive.

5. The directed munition of claim 4, wherein the casing is made of a plastic material.

6. The directed munition of claim 4, wherein the casing is made of a composite material.

7. The directed munition of claim 1, further comprising a ring at least partially within the casing;

wherein the ring is operatively coupled to the fragments to control spread of the fragments out of the opening, when the explosive is detonated.

8. The directed munition of claim 7, wherein the ring is configured to be mostly reduced to powder upon detonation of the explosive.

9. The directed munition of claim 7, wherein the ring is made of sintered metal.

10. The directed munition of claim 7, wherein the ring is fully within the casing.

11. The directed munition of claim 1, wherein the energetic explosive portion and detonator are on opposite ends of the insensitive explosive portion.

12. The directed munition of claim 11, wherein the volume of the insensitive explosive portion is greater than that of the energetic explosive portion.

13. The directed munition of claim 1 wherein the sensitive explosive portion and insensitive explosive portion are both outside of the detonator.

14. The directed munition of claim 1, wherein the volume of the insensitive explosive portion is at least twice greater than that of the energetic explosive portion.

15. A directed munition, comprising:

a casing;

a ring at least partially within the casing;

an explosive within the casing; and fragments operatively coupled to the explosive, to be directed out of a front opening of the casing when the explosive is detonated;

wherein the explosive includes an insensitive explosive portion containing an insensitive explosive, and an energetic explosive portion that contains a relatively sensitive explosive that is more energetic than the insensitive explosive;

wherein the energetic explosive portion is closer to the fragments than the insensitive explosive portion;

wherein the ring runs along an inner surface of the casing, surrounding a part of the explosive; and wherein the ring is operatively coupled to the fragments to control spread of the fragments out of the opening, when the explosive is detonated.

16. The directed munition of claim 15, wherein the part of the explosive surrounded by the ring is the energetic explosive portion.

17. A directed munition comprising:

a casing;

an explosive within the casing;

fragments operatively coupled to the explosive, to be directed out of a front opening of the casing when the explosive is detonated; and a ring at least partially within the casing;

wherein the ring is operatively coupled to the fragments to control spread of the fragments out of the opening, when the explosive is detonated; and wherein the ring is configured to be mostly reduced to powder upon detonation of the explosive.

18. The directed munition of claim 17, wherein the ring is made of sintered metal.

19. The directed munition of claim 17, wherein the ring is fully within the casing.

20. The directed munition of claim 17, wherein the ring runs along an inner surface of the casing, surrounding a part of the explosive.

* * * * *